US005343808A

United States Patent [19]

Collar

[11] Patent Number: 5,343,808

[45] Date of Patent: Sep. 6, 1994

[54] FIRECRACKER CONSTRUCTION

[75] Inventor: David L. Collar, Leawood, Kans.

[73] Assignee: Winco Fireworks, Inc., Overland Park, Kans.

[21] Appl. No.: 68,788

[22] Filed: Jun. 1, 1993

[51] Int. Cl.[5] ..... F42B 4/04

[52] U.S. Cl. ..... 102/361

[58] Field of Search ..... 102/361

[56] References Cited

U.S. PATENT DOCUMENTS

| | | | |
|---|---|---|---|
| 619,177 | 2/1899 | Hinton | 102/361 |
| 883,856 | 4/1908 | Bowman | 102/361 |
| 1,610,645 | 2/1925 | Adler | 102/361 |
| 2,174,202 | 9/1939 | Cimorosi | 102/361 |
| 3,749,018 | 7/1973 | Germershausen | 102/361 |
| 4,052,940 | 10/1977 | Gits et al. | 102/361 |
| 4,566,388 | 1/1986 | Loyd, Jr. | 102/361 |
| 4,976,201 | 12/1990 | Hamilton | 102/361 |

*Primary Examiner*—Peter A. Nelson

*Attorney, Agent, or Firm*—Litman. McMahon & Brown

[57] ABSTRACT

A firecracker construction includes a relatively small firecracker mounted within an enlarged supplemental housing so that an elongated fuse projects outwardly. Except for a portion of the projecting fuse, the smaller firecracker within the housing is completely surrounded by a solid, noncombustible material which enhances the report of the exploding firecracker.

Preferably the construction includes a U.S. Department of Transportation Hazard Class 1.4G explosive. Other preferred forms include a safety fuse. In particularly preferred forms, the noncombustible material is formed of clay, calcium sulfate, or a mixture thereof.

14 Claims, 1 Drawing Sheet

FIRECRACKER CONSTRUCTION

BACKGROUND OF THE INVENTION

1. Field of the Invention

The present invention is broadly concerned with a firecracker construction which employs a relatively small firecracker to produce a disproportionately loud report without increasing the explosive content of the charge, so that children and other users experience a louder explosion without the need for handling dangerous quantities of explosive. Advantageously, the firecracker is safer and causes fewer injuries than firecrackers of similar size and loudness of report. Moreover, the firecracker construction of the invention is even safer than standard small firecrackers in that it employs a green safety fuse not customarily required for such smaller explosive compositions.

More particularly, it is concerned with a firecracker having a safety fuse, which is mounted within a larger casing so that the fuse projects outwardly. Except for the projecting portion of the fuse, the firecracker is completely surrounded by a solid, noncombustible material. Lighting the fuse results in an explosion of the firecracker accompanied by production of an enhanced report and disintegration of the surrounding solid material into a powdered form.

2. Description of the Related Art

A number of explosive devices have been proposed in the past which enclose a relatively small firecracker-type device or charge within an enlarged outer housing. Generally these devices do not completely surround the smaller firecracker or charge with noncombustible material. Certain of these devices mount the smaller firecracker within an otherwise empty larger barrel in order to direct the exploding charge or to facilitate handling. Others partially surround the smaller firecracker with noncombustible material with at least one end of the charge remaining in contact with the end of the enlarged barrel. However, none of the related devices completely surround all but a portion of the projecting fuse of the smaller firecracker with a solid, noncombustible material of sufficient strength to cause substantially increased compression of the exploding gases, thereby employing a relatively safer, smaller firecracker to create a louder sound.

SUMMARY OF THE INVENTION

The present invention overcomes the problems previously outlined and provides a greatly improved firecracker construction. Broadly speaking, the construction includes a relatively small firecracker mounted within an enlarged supplemental housing so that an elongated fuse projects outwardly. Except for a projecting portion of the fuse, the smaller firecracker within the housing is surrounded on all sides by a solid, noncombustible material which enhances the report of the exploding firecracker.

Preferably the construction includes a U.S. Department of Transportation Hazard Class 1.4G explosive. Other preferred forms include a safety fuse. In particularly preferred forms, the noncombustible material is formed of clay, calcium sulfate, or a mixture thereof.

OBJECTS AND ADVANTAGES OF THE INVENTION

The principal objects and advantages of the present invention include: providing a firecracker construction that meets the safety requirements of The Consumer Product Safety Commission and U.S. Department of Transportation Hazard Class 1.4G, yet provides an enhanced audible effect; providing such a construction that maintains the firecracker in spaced relationship to the walls of a supplementary housing; providing such a construction that completely surrounds all but a projecting portion of the fuse of a firecracker with a solid, noncombustible material within a supplementary housing; providing such a construction that employs a noncombustible material to increase the pressure of the exploding firecracker without decreasing the force of the explosion; providing such a construction that employs a noncombustible material which is provided as a liquid or damp powder and which sets to a solid material; providing such a construction that employs a safety fuse; providing such a construction that employs a safety fuse having a burn time of about 3 to 6 seconds; providing such a construction that employs a supplementary housing having a fuse-opening; providing such a construction that employs a noncombustible clay mixture; providing such a construction that employs a noncombustible calcium sulfate mixture; providing a method of constructing such a firecracker; providing such a construction that meets all U.S. Department of Transportation and Consumer Product Safety Commission requirements; providing such a construction that is of economical manufacture; providing such a construction that expends the smallest possible energy to achieve the loudest auditory effect; providing such a construction that is larger in size and produces a louder report, but does not have increased explosive content.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
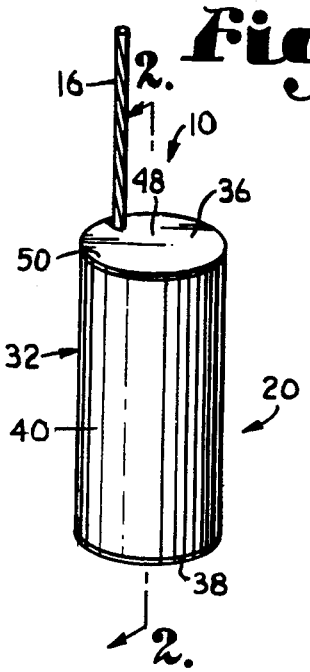
FIG. 1 is a perspective view of a firecracker construction of the present invention.
Figure 2:
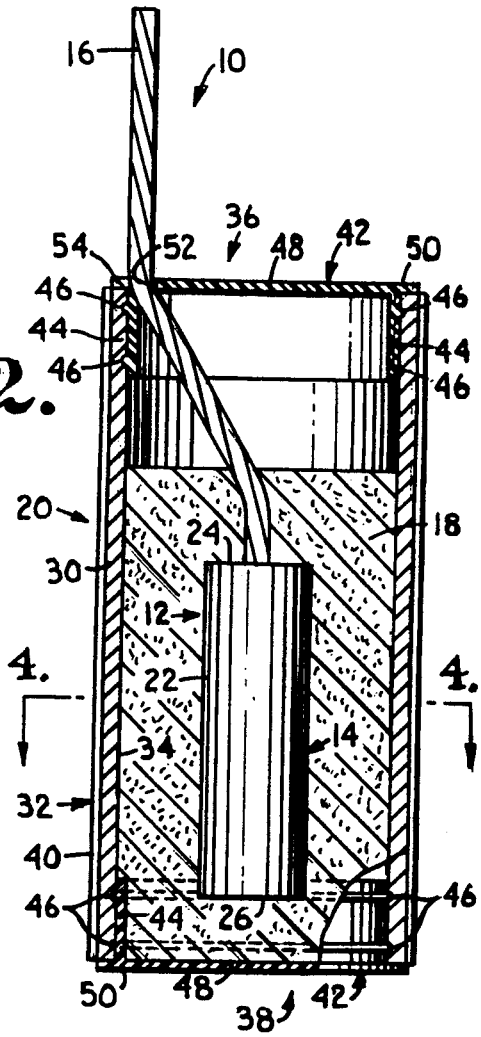
FIG. 2 is a longitudinal sectional view taken along line 2—2 of FIG. 1 with portions broken away to show the exterior of the bottom flange.
Figure 3:
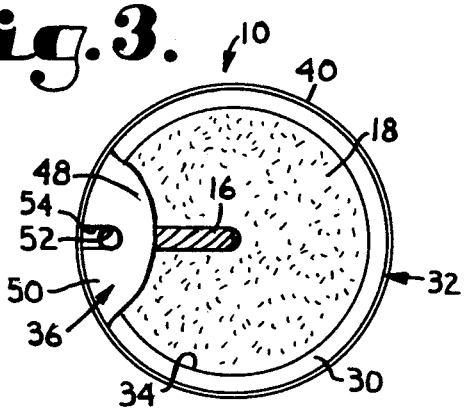
FIG. 3 is a top plan view of the invention depicted in FIG. 1 with parts broken away showing the fuse and clay filler.
Figure 4:
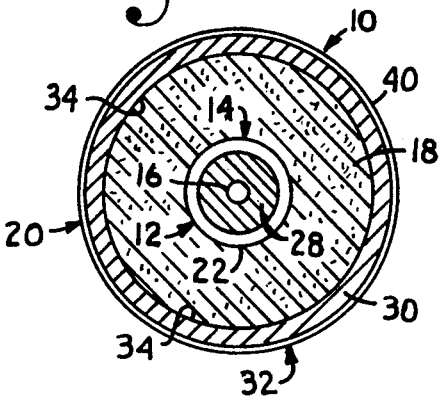
FIG. 4 is a cross sectional view taken along line 4—4 of FIG. 2.
Figure 5:
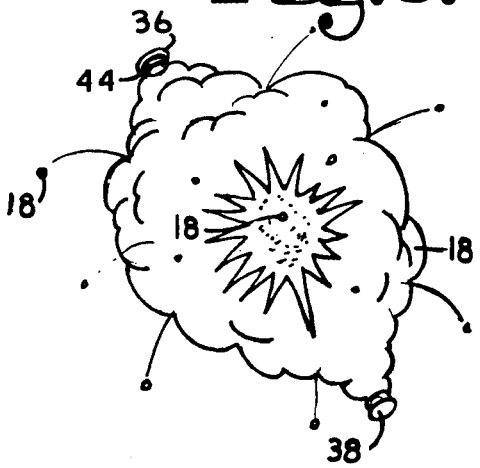
FIG. 5 is a perspective view of an exploding firecracker of construction similar to that depicted in FIG. 1.

Referring now to the drawing, a firecracker construction 10 in accordance with the invention includes a firecracker 12 having a housing 14 and a projecting fuse 16, the housing 14 being completely surrounded by noncombustible material and encased within an enlarged supplemental housing 20, with the fuse 16 extending outwardly.

In more detail, firecracker housing 14 includes a generally cylindrical tube 22 having a top 24 and bottom 26 encasing a quantity of an explosive charge 28. Both housing 14 and supplementary housing 20 may be formed of rolled paper materials such as cardboard, plastic, or any other suitable material.

The preferred firecracker 12 meets the safety requirements of The Consumer Product Safety Commission and U.S. Department of Transportation Hazard Class 1.4G (formerly Class C explosives). Charge 28 includes up to about 50 milligrams of any low explosive compound or mixture thereof which will deflagrate upon initiation by a flame or spark, but which will not detonate. Preferred firecrackers employ a mixture of 60% by weight potassium perchlorate, 30% magnesium, and 10% sulfur. Especially preferred explosives are relatively thermally stable, resulting in a finished item capable of withstanding temperatures of up to about 167° F. for at least about 48 hours.

The preferred fuse 16 is an elongated safety fuse, of the type commonly designated a "green safety fuse," although other types of fuse, such as paper fuses may also be employed. The preferred safety fuse burns from at least about 3 seconds to about 6 seconds to permit a user to reach a safe distance away from the exploding firecracker.

The preferred noncombustible material is formed of clay, such as "fire clay", plaster of paris (calcium sulfate, gypsum), or a mixture thereof, although any suitable material which is not subject to combustion may be employed. Damp material 18 may be packed in around firecracker 12 and permitted to harden, or the material may be poured in as a liquid, such as plaster of paris, and allowed to set.

Outer, supplemental housing 20 includes a tubular casing 30 having an outside surface 32, inside surface 34, top 36 and bottom 38. A colorful paper covering 40 may extend over outside surface 32 and may include printing and design work.

Top and bottom portions 36, 38 each include a generally circular, disc-shaped planar portion 42 coupled with a respectively depending or upstanding flange 44. Flanges 44 each include a pair of axially projecting circumferential ridges 46 which assist in obtaining a friction fit between flanges 44 and inside housing surface 34.

Top and bottom planar portions 42 each include a medial portion 46 and a lateral tube-contacting portion 48 which extends axially beyond flange 44. Top planar portion 42 includes an aperture 50 to permit extension of a portion of fuse 16 outwardly therethrough, and away from housing 20. Top flange 44 likewise includes an aperture or groove 54 in order to accommodate fuse 16 as it passes outwardly through aperture 50. Top and bottom 36, 38 are preferably formed of plastic or other similar lightweight material and are tightly fitted to casing 30 so as to form a seal against leakage of liquid noncombustible material 18.

The firecracker composition 10 of the present invention is constructed by coupling a DOT Hazard Class 1.4G explosive charge 28 in a tubular casing 22 with an elongated green safety fuse 16. The resulting firecracker 12 is then mounted in spaced relationship to the walls of an enlarged tubular housing 20, so that a portion of the fuse projects outwardly from the top end. A noncombustible material 18 is damp-packed or poured around the firecracker 12 so that except for a portion of the projecting fuse, it is completely surrounded on all sides by a layer of material. An apertured top end-cap 36 is installed with fuse 16 projecting outwardly and the material 18 is permitted to set to a hardened state.

In use, an individual grasps the firecracker composition 10 by its supplemental housing 20. Because housing 20 is substantially larger than the encased firecracker 12, it is relatively easy for even small fingers to grasp. The user then applies a match, lighter, or any other ignition source to elongated green safety fuse 16. In preferred uses, the firecracker is not held, but rather is placed on the ground or other level, noncombustible surface and ignited.

The user then stands back a suitable distance and waits 3 to 6 seconds for fuse 16 to burn down to explosive charge 28. Upon explosion of the charge 28, noncombustible material 18 temporarily contains the exploding gases without absorbing the energy of the explosion, resulting in a substantially enhanced report. The shock wave reduces the solid noncombustible material 18 to harmless powder.

Advantageously, the firecracker construction 10 of the present invention is safer and causes fewer injuries than similar DOT Hazard Class 1.4G firecrackers because it employs a green safety fuse having a bum time of 3 to 6 seconds. Moreover, children and other users of firecracker construction 10 experience a louder explosion, commensurate with use of an explosive in excess of DOT Hazard Class 1.4G.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

It is to be understood that while certain forms of the present invention have been illustrated and described herein, it is not to be limited to the specific forms or arrangement of parts described and shown.

The following is claimed and desired to be secured by Letters Patent:

1. A firecracker construction comprising:

a. a firecracker having an explosive charge coupled with an elongated fuse member;

b. an enlarged housing having walls;

c. said firecracker and said fuse being mounted within said housing in spaced relationship to said walls, with a portion of said fuse member projecting outwardly from said housing for permitting remote ignition of said firecracker; and d. a quantity of solid, noncombustible material disposed between said firecracker and said housing walls and contacting said firecracker in completely surrounding relationship, except for said projecting portion of said fuse member, for enhancing the report of said firecracker upon explosion.

2. The firecracker construction as set forth in claim 1, wherein said firecracker is a U.S. Department of Transportation Hazard Class 1.4G explosive.

3. The firecracker construction as set forth in claim 1, wherein said fuse member comprises a safety fuse having a burn time of from at least about 3 seconds to about 6 seconds.

4. The firecracker construction as set forth in claim 1, wherein said housing includes structure defining an opening for permitting extension of said portion of said fuse member outwardly from said housing.

5. The firecracker construction as set forth in claim 1, wherein said noncombustible material is provided as a liquid which sets to a solid material.

6. The firecracker construction as set forth in claim 1, wherein said solid, noncombustible compound comprises a clay mixture.

7. The firecracker construction as set forth in claim 1, wherein said solid, noncombustible compound comprises a calcium sulfate mixture.

8. A method of constructing a firecracker, comprising:

a. providing a firecracker having an explosive charge coupled with an elongated fuse member;

b. providing an enlarged housing having walls;

c. providing a quantity of a solid, noncombustible material;

d. mounting said firecracker within said housing in spaced relationship to said walls, with a portion of said fuse member projecting outwardly from said housing for permitting remote ignition of said firecracker; and e. disposing said noncombustible material between said firecracker and said housing walls, said noncombustible material contacting said firecracker in completely surrounding relationship, except for said projecting portion of said fuse member, for enhancing the report of said firecracker upon explosion.

9. The method of constructing a firecracker as set forth in claim 8, wherein said firecracker is a U.S. Department of Transportation Hazard Class 1.4G explosive.

10. The method of constructing a firecracker as set forth in claim 8, wherein said fuse member comprises a safety fuse having a burn time of from at least about 3 seconds to about 6 seconds.

11. The method of constructing a firecracker as set forth in claim 8, wherein said housing includes structure defining an opening for permitting extension of said portion of said fuse member outwardly from said housing.

12. The method of constructing a firecracker as set forth in claim 8, wherein said solid, noncombustible compound is provided as a liquid which sets to a solid composition.

13. The method of constructing a firecracker as set forth in claim 8, wherein said solid, noncombustible compound comprises a day mixture.

14. The method of constructing a firecracker as set forth in claim 8, wherein said solid, noncombustible compound comprises a calcium sulfate mixture.

* * * * *